United States Patent [19]

Danneels et al.

[11] 4,070,265

[45] Jan. 24, 1978

[54] ELECTROPLATING DEVICE FOR PARTIALLY PLATING ITEMS IN TRANSIT

[75] Inventors: Laurent Danneels, Varsenare; Johan Helder, Brugge; Jan Kuypers, Brugge; James Piolon, Ostende, all of Belgium; Wolfgang Pernegger, Erlangen, Germany

[73] Assignee: Siemens Aktiengesellschaft, Berlin & Munich, Germany

[21] Appl. No.: 636,426

[22] Filed: Dec. 1, 1975

[30] Foreign Application Priority Data

Dec. 20, 1974 Germany ..... 2460574

[51] Int. Cl.[2] ..... C25D 17/00

[52] U.S. Cl. ..... 204/206; 204/28; 204/198; 204/237

[58] Field of Search ..... 204/28, 198, 206, 237

[56] References Cited

U.S. PATENT DOCUMENTS

| | | | |
|---|---|---|---|
| 1,768,358 | 6/1930 | Harrison | 204/28 |
| 2,497,894 | 2/1950 | Luke | 204/28 |
| 3,277,553 | 10/1966 | Wesolowski | 29/25.31 |
| 3,579,430 | 5/1971 | Lawler | 204/206 |

FOREIGN PATENT DOCUMENTS

| | | | |
|---|---|---|---|
| 1,022,775 | 3/1953 | France | 204/206 |

*Primary Examiner*—F.C. Edmundson

*Attorney, Agent, or Firm*—Hill, Gross, Simpson, Van Santen, Steadman, Chiara & Simpson

[57] ABSTRACT

This invention relates to an electroplating device for partially plating a series of items moving along a path at a constant level, the device including at least one electroplating bath positioned along the path having end walls with slots therein through which the items to be plated may pass, and an end wall configuration adjacent the slot which combines with a circulation pump to maintain a constant liquid level in the bath above the bottom of the slot.

6 Claims, 5 Drawing Figures

ELECTROPLATING DEVICE FOR PARTIALLY PLATING ITEMS IN TRANSIT

BACKGROUND OF THE INVENTION

Field of the Invention

This invention relates to electroplating devices and more particularly to a treatment bath for treating items moving therethrough at a constant level, the bath having an end wall configuration to pass the items while maintaining a constant level of liquid in the bath.

Electroplating devices for partially plating items which move in transit at a constant level through at least one treatment bath in which the treatment liquid level is maintained constant and which has end walls with slots therethrough for passing the items in transit at a level below the top of the liquid level are known. Such devices utilize a circulation pump having a delivery side connected to the treatment bath and an intake operatively coupled to an overflow from the end walls of the treatment bath.

This type of continuously operating electroplating device is known, for example, from German Offenlegungsschrift No. 1,796,017. In such prior art electroplating devices, the items to be partially plated, for example, relay springs and the like, are conveyed by a transfer device through a plurality of elongated treatment baths. Only those portions of the items which are actually to be plated are dipped into the liquids in the treatment baths. In order that the items in transit can be moved through the treatment liquids at a uniform level, i.e. at a constant depth of penetration into the liquid, the end walls of the treatment baths have slot openings through which the items can pass. The liquid levels are maintained constant in the treatment bath by means of circulation pumps which recirculate liquid discharging through the slots back into the bath. The actual level of liquid in the bath and, therefore, the depth of submersion of the items passing through the baths, is determined by devices allowing variation in dimensioning of the slots. Such devices have included adjusting plates by means of which the effective depth of the slots can be adjusted.

Because the manipulation of the prior art adjustment plates is a very awkward operation, adjustment and regulation of the liquid level in the treatment baths has involved a considerable amount of time. Further, fluctuations in the quantity of liquids circulating, due for example, to progressing fouling of a filter installed in the pump circuit, give rise to fluctuations of liquid level in the treatment baths which can occur before the adjustment plates can be changed to correct the situation. Thus, an accurate control of the amount of partial plating applied to the items in transit cannot be maintained.

It would therefore be an advance in the art to provide a means for more accurately maintaining the liquid level in the treatment baths.

SUMMARY OF THE INVENTION

It is therefore the primary object of this invention to provide an electroplating device of the type above described in which the afore-mentioned difficulties of adjustment and regulation of the liquid level are avoided.

According to the teachings of this invention, the above object is obtained with the use of an electroplating device as above described wherein at least one of the two slots in the end walls of the electroplating bath is increased in width at a height corresponding to the desired level of the treatment liquid. By this means, a fixed weir is obtained. Further the overall individual treatment bath is mounted through a vertically adjusted mounting member. To adjust the liquid level, the circulating quantity of the liquid is first metered through either control of the pump performance or through the use of an intermediary metering device such as a regulator valve. The level is metered such that the top edge of the weir is just wetted by the liquid. Thereafter, by vertically adjusting the treatment bath, the depth of penetration of the items being electroplated will be adjusted to the required figure. After this adjustment has been made, the normal fluctuations in the quantity of liquid circulation, which are relatively minor, will produce no undesired fluctuations in the level of the liquid. It is therefore not necessary to provide further adjustments. This automatic (within limits) regulation of liquid level is achieved by the combination of relatively a narrow slot designed to pass the items and the relatively wider weir. Because of this combination, with respect to liquid levels at approximately the height of the top edge of the weir, there is a very small liquid level fluctuation in the treatment bath in response to even large fluctuations in the overall liquid flow through the bath.

In the preferred embodiment the weir will be at least 100 mm wide. At this minimum width, effective self-regulation of the liquid level is achieved while at the same time retaining the possibility of full height end walls adjacent the sides of the electroplating bath for positioning of anode rods in a protected manner.

In a further described embodiment of this invention, in order to obtain better liquid level regulation characteristics over a wide regulating range in the downward level direction, it is possible to use an inclined weir. The incline gradient of the top edge of the weir towards the slot passing the items to be electroplated should be approximately 5% or less. An effect similar to an inclined weir can be obtained using a weir whose top has a curved profile from the outside edge of the weir to the slot.

In the preferred embodiment illustrated, the treatment bath is mounted on feet members which are vertically adjustable. Due to the use of such vertically adjustable individual feet, in addition to accurate adjustment of the depth of penetration of the items into the liquid in the bath, the bath can also be easily horizontally aligned. Further, by this means, in those systems where there are a plurality of successive treatment baths it is possible to utilize the feet to provide for differing depths of penetration even when the baths are all supported on the same base support. This ability to differentiate in penetration depth can be important, for example, in electrolytic degreasing where greater depths of penetration of the items are desired than during a subsequent step of electroplating.

It is therefore an object of this invention to provide an electroplating device wherein the electroplating bath has end walls with slots therethrough to pass items to be electroplated, the end walls having a fixed weir adjacent the slot, and the bath member being supported on vertically adjustable mountings.

Other objects, features and advantages of the invention will be readily apparent from the following description of a preferred embodiment thereof, taken in conjunction with the accompanying drawings, although variations and modifications may be effected without departing from the spirit and scope of the novel concepts of the disclosure and in which:

DESCRIPTION OF THE PREFERRED EMBODIMENTS

Figure 2:
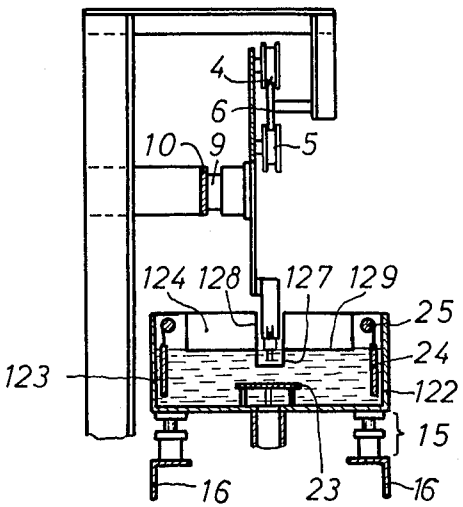
FIG. 2 is a cross sectional view taken along the lines II—II of FIG. 1.
Figure 1:
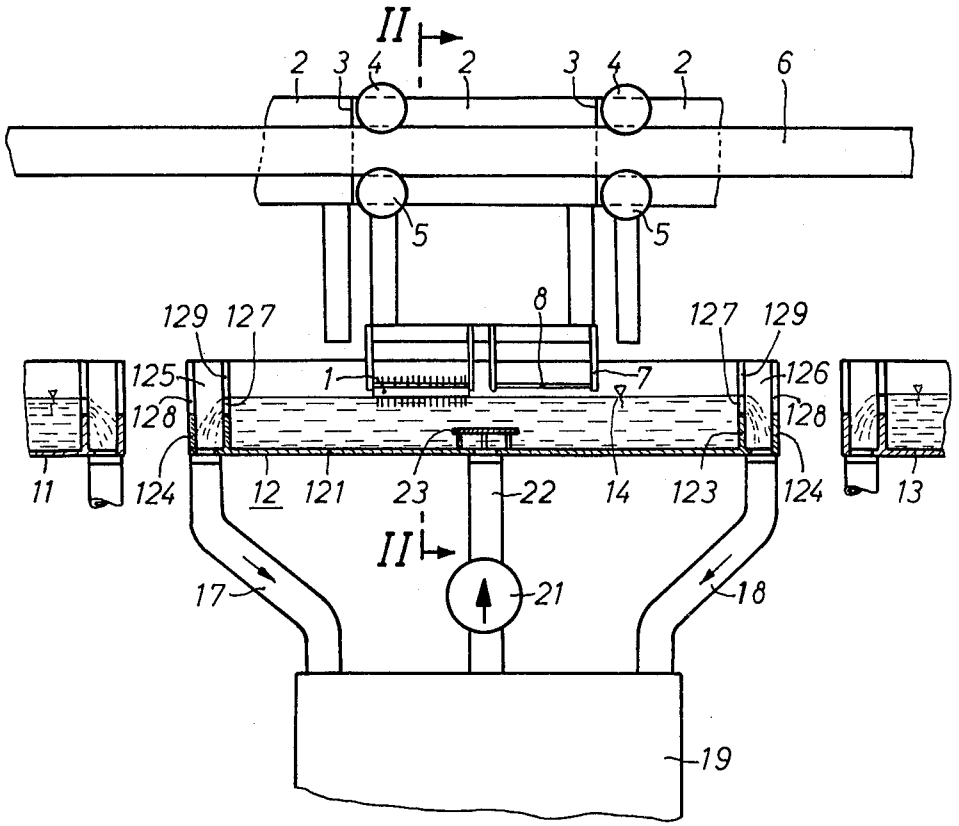
FIG. 1 is a longitudinal section of an electroplating device according to this invention.

FIGS. 1 and 2 are, respectively, longitudinal and cross sectional views of portions of an electroplating device for the partial plating of two-row pin strips. The individual pin strips 1 are moved through the device suspended from an electrically conductive contacting and transfer carriage 2 at a constant speed and at a uniform level. The individual pin strip rows may be passed through a plurality of pre-treatment and electroplating baths with only that part of the pin strip which is to be partially plated actually penetrating into the particular liquid. The transfer carriage assembly includes a plurality of individual transfer carriages 2 which are articulatably attached together as by means of hinges 3. The drive to the carriages, not shown on the drawing, may for example, be through by means of polygonal wheels whose edge length is matched to the length of the individual carriages 2.

Each of the transfer carriages is guided on rails 6 by means of rollers 4 and 5 and is provided with a pin strip holder 7 designed to accommodate two individual pin strips 1. Because each individual pin in a pin strip has to be electrically contacted, the pin strip holders 7 are provided with contact clamping bars 8 made of corrosion-resistent material. The contact bars 8 may have a diameter slightly larger than the interval between two adjacent rows of pins in a strip. In this manner electrical contact is made between the two pin rows of each strip and the intervening contact bar 8 at the time of loading of the strips.

For additional electric contact, the individual pin strip holders 7 are conductively connected to one another and are grounded by carbon brushes 9 contacting a cathode rail 10.

The electroplating baths through which the individual pin strips pass are preferably in the form of elongated baths. In FIG. 1 only the consecutive baths 11, 12 and 13 are actually shown however there may be a larger or lesser number used. Since the baths are similar in design, a description of the treatment bath 12 will be typical. The bath 12 may contain a liquid 14, for example a gold electrolyte. The bath 12 consists of a base member 121, two long side walls 122 and two end walls 123. The base 121 and the long side walls project at both ends beyond the end walls 123 to additional opposite end walls 124. The space between the end walls 123 and the end walls 124 forms overflow chambers 125 and 126. In order for the pin strips to pass the end walls 123 and 124 to the interior of the treatment bath 12 at a uniform level, the end walls are equipped with slots 127 through the walls 123 and slots 128 through the walls 124.

At a height corresponding to the desired level of liquid 14, the slots 127 in the end walls 123 are enlarged in width to form a fixed overflow weir 129.

The treatment bath 12, which is preferably constructed of material compatible with the bath liquid, for example polypropylene, is vertically adjustably mounted on feet 15 which are carried by frame member 16.

The treatment liquid 14 continuously flows out of the slots 127 and over the weir wall 129 into the overflow chambers 125 and 126. The liquid then passes through drain lines 17 and 18 to a reservoir and buffer vessel 19. In order to maintain liquid level in the treatment bath at a constant height, the treatment liquid 14 is continuously pumped back from the reservoir and buffer vessel 19 through a suction line 20 to a variably delivery filter pump 21 which discharges to a delivery line 22 which in turn, discharges to the bath 12. At a point at which the delivery line 22 discharges into the bath 12, a baffle plate 23 may be fitted to the bath preventing the development of waves on the surface of the treatment liquid in the bath. Plate-like anodes 24 suspended from anode rods 25 may be positioned adjacent the long side walls of the bath, as shown in FIG. 2.

The liquid level of the bath is controlled in the following manner. First, the pump 21 is adjusted to provide a stable operating condition in which the flow of liquid to the bath provides a liquid level at which the top surfaces of the overflow weirs 129 are just wetted. Although the adjustment of this level can be obtained by the variably delivery pump, an intermediate regulating valve may also be provided in the pump circuit. Thereafter the treatment bath 12 is horizontally aligned by adjustment of the vertically adjustable feet 15, and when horizontal, its height above the frame member 16 is adjusted to the point that the pin strip 1 will penetrate the liquid level to the desired extent. By this means, the liquid level with respect to the fixed weir is not changed in order to increase or decrease penetration of the pins in the liquid, rather the position of the bath with respect to the pin strip holders 7 is adjusted.

Once this adjustment has been obtained, it can be said that the total quantity Q of liquid 14 which passes through the circulating liquid system will be made up of sub-quantities Q1 and Q2. Q1 is the quantity of liquid escaping through the slots 127 and Q2 stands for that additional quantity of liquid passing over the weirs 129. If relatively minor fluctuations $\Delta Q$ occur in the overall quantity Q, for example as a result of filter fouling, temperature differences, and the like, then the following possibilities can occur:

a. If the total quantity Q increases by $\Delta Q$, then the fluctuation $\Delta Q$ will occur exclusively in the overflow quantity Q2. That is to say the increase $\Delta Q$ flows out of the treatment bath over the full width of the top of the weir 129 without appreciably increasing the level of the treatment liquid 14:

b. If the total quantity Q is reduced by an amount $\Delta Q$, then the reduction $\Delta Q$ first reduces the overflow quantity Q2. In such a case there will be no appreciable reduction in the liquid level in the bath provided that $\Delta Q \leqq Q2$.

The fluctuations $\Delta Q$ in the overall quantity Q thus produce minor fluctuations in the liquid level. Such minor fluctuations will have no effect upon the quality of the partial plating operation. With this construction, readjustment of the pump output only becomes necessary if the fluctuation Δ Q exceeds certain limiting values.

Figure 3:
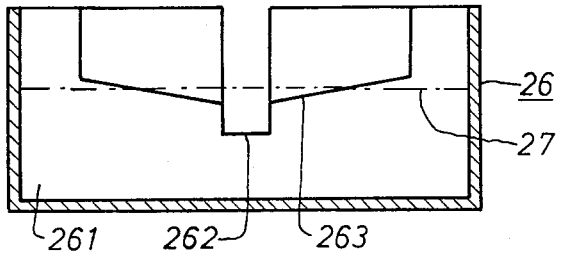
FIG. 3 is a partially sectional view through a treatment bath illustrating an end wall configuration.
Figure 4:
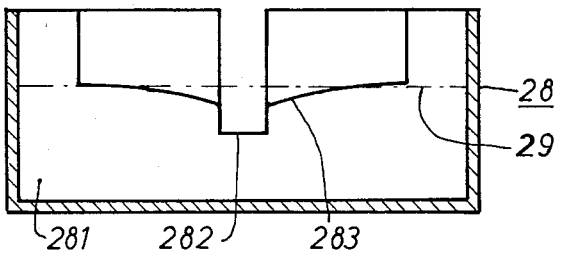
FIG. 4 is a view similar to FIG. 3 illustrating a different end wall configuration.

FIG. 3 is a cross sectional view of a treatment bath illustrating a modification of the design of the overflow weir. The slot 262 for passage of the items to be plated formed in the end wall 261 of the treatment bath 26, the end wall corresponding to a wall 123, is enlarged at a point spaced from the bottom of the slot to form an oblique weir 263. If the inclination of the weir top from the center of slot 262 is no greater than about 50% then the oblique weir 263 will produce a level regulating characteristic with an increased regulation range in the declining level direction.

In the embodiment of FIG. 3, the desired liquid level would intersect a central zone on the inclined top of the weir, as indicated by the dotted line 27.

Figure 5:
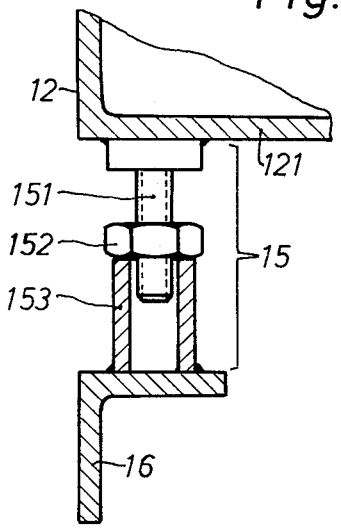
FIG. 5 is a fragmentary enlarged sectional view of a vertically adjustable mounting device for a treatment bath.

A further modification of the weir design is shown in FIG. 5 in a cross section similar to FIG. 3. The slots 282 formed in the end wall 281 of treatment bath 28 have been increased in width to form a curved overflow weir 283. In this embodiment, as in the case of the embodiment of FIG. 3, a wider regulating range in the downward direction is achieved. The regulating characteristic is determined by the nature of the curvature of the weir crest. In this instance, the desired liquid level will again intersect a central area of the crest profile as indicated by the dotted line 28.

FIG. 5 is an enlarged fragmentary sectional view of a simple form of adjustable foot 15 of the type illustrating supporting the treatment bath in FIG. 2. The foot 15 consists of a threaded rod member 151, an adjustment nut 152 and a sleeve 153. The head of the rod or bolt 151 is affixed to the base 121 of the treatment bath. The sleeve 153 is attached, as by means of welding, to the frame 16. Vertical adjustment of the bath 12 is therefore affected by rotating the nut 152 which is threaded onto the bolt or rod 151 and supported on the end of sleeve 153. Particularly, through the use of a very fine thread, the simple construction illustrated in FIG. 5 can achieve an accurate adjustment of the height of the treatment bath 12.

It can therefore be seen from the above that our invention provides a device for partially electroplating items which are moved at a constant level through one or more treatment baths, the depth of penetration of the items into the liquid in the treatment bath being controlled. The treatment baths are provided with end walls having slots therein for passing the items to be treated at a constant level through the bath. The slots, have an increased width spaced from the slot bottom, the increase forming an overflow weir. The provision of the weir maintains liquid level in the bath at a constant depth. Adjustment of the depth of penetration of the items to be plated is achieved by mounting the treatment bath on vertically adjustable members and by thereafter raising and lowering the bath.

Although the teachings of our invention have herein been discussed with reference to specific theories and embodiments, it is to be understood that these are by way of illustration only and that others may wish to utilize our invention in different designs or applications.

We claim as our invention:

1. An electroplating device for the partial plating of items passing through the device at a substantially constant level, the device including at least one treatment bath positioned along a path followed by the items, the bath containing a treatment liquid therein, the bath having end walls with vertical slot openings therethrough through which the items pass, liquid flowing through said slots to the exterior of the treatment bath and a circulation pump returning the liquid flowing through said slots to the interior of the bath, the improvement of at least one of said vertical slots being increased in width at a point spaced from a slot bottom, the increase in width forming a fixed weir extending outwardly from said slot above the slot bottom and below side walls of the bath, vertically adjustable means supporting said treatment bath allowing vertical adjustment of the bath to locate the weir at a desired height with respect to the level of the items, and the weir having overflow top portions thereof positioned at a height of desired liquid level in the bath.

2. The improvement of claim 1 wherein the weir has a width of at least 100 mm.

3. The improvement of claim 1 wherein the weir top is inclined extending outwardly and upwardly from the slot at an angle less than approximately 5%.

4. The improvement of claim 1 wherein the weir top is vertically curved.

5. The improvement of claim 1 wherein the adjustable mounting means comprise: feet members on said bath supporting the bath on a fixed support surface, the feet members being adjustable whereby the distance between a bottom of the bath which the feet are attached and the fixed support can be adjusted.

6. An electroplating bath comprising: a bath member having a base, side walls and end walls, said end walls having slots extending downwardly thereinto from a top surface thereof and terminating in spaced relation to the base, a liquid circulation system flowing liquid into said bath, outward from said bath through said slots thence through conduit to a pump member thence to said bath, means adjusting flow through said circulation system, liquid level means maintaining a substantially constant liquid level in said bath, said liquid level means including an overflow weir in at least one end wall, said overflow weir formed as an increased width section of said slot spaced from a bottom of said slot, the weir having an overflow top spaced from the slot bottom and below tops of the side walls with portions thereof positioned at a desired liquid level in said bath, and said bath being equipped with vertically adjustable support means, means passing items to be plated through the slots and bath at a constant level below the overflow top portions and the vertically adjustable support means effective to allow vertical adjustment of the bath with respect to a support on which said bath rests to vertically locate the portions of the overflow top at a desired height with respect to the level of the items.

* * * * *